United States Patent [19]

Gmelin et al.

[11] 4,306,530

[45] Dec. 22, 1981

[54] FUEL INJECTION SYSTEM

[75] Inventors: Karl Gmelin, Ingelfingen; Hermann Nusser, Asperg; Peter Stiefel, Ditzingen; Klaus-Jürgen Peters, Affalterbach, all of Fed. Rep. of Germany

[73] Assignee: Robert Bosch GmbH, Stuttgart, Fed. Rep. of Germany

[21] Appl. No.: 112,498

[22] Filed: Jan. 16, 1980

[30] Foreign Application Priority Data

Jan. 22, 1979 [DE] Fed. Rep. of Germany ..... 2902355

[51] Int. Cl.[3] ..... F02M 39/00

[52] U.S. Cl. ..... 123/461; 123/454

[58] Field of Search ..... 123/516, 461, 454

[56] References Cited

U.S. PATENT DOCUMENTS

| | | | |
|---|---|---|---|
| 3,031,010 | 4/1962 | Wise | 123/461 |
| 4,079,717 | 3/1978 | Shirose | 123/461 |
| 4,132,211 | 1/1979 | Wilfert | 123/454 |

*Primary Examiner*—Ronald B. Cox

*Attorney, Agent, or Firm*—Edwin E. Greigg

[57] ABSTRACT

A fuel injection system which serves to supply fuel to a mixture-compressing, externally ignited internal combustion engine which includes an air flow rate member for actuating a metering and distribution valve, a flushing valve is disposed in an outlet line leading from each injection valve to a return flow line open when the engine is turned off and immediately after actuation of the ignition switch of the engine, enables a return flow via the outlet lines of the fuel flowing through the fuel supply line and the metering and distribution valve assembly to the injection valves until an electromagnetic valve drivable by a time control element opens a pressure line to a pressure chamber of the flushing valve, and the pressure prevailing in the pressure chamber opens a diaphragm connected to the movable valve parts of the flushing valve in such a manner that the flushing valve closes. Simultaneously with the opening of the electromagnetic valve, the electrical circuit of the starter motor is closed, so that after the preceding filling with fuel of all the lines and assemblies of the fuel injection system with fuel, a more certain start of the engine is assured.

1 Claim, 1 Drawing Figure

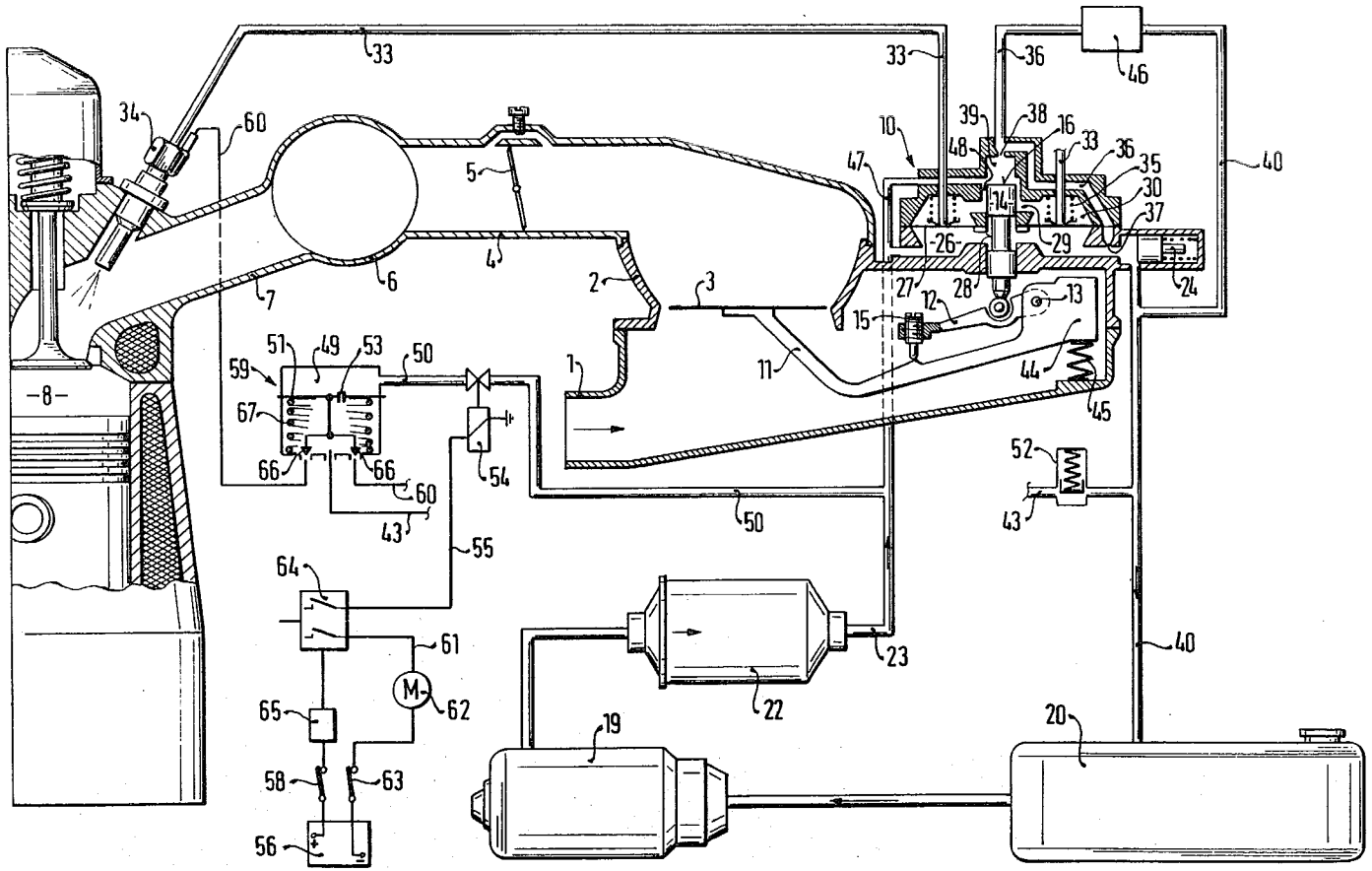
40
46
24
35
30
37
36
33
16
38
36
39
48
14
29
13
45
44
52
43
20
28
26
12
27
15
10
47
33
23
22
11
50
3
2
1
19
5
4
54
55
61
62
50
60
43
63
6
53
66
49
51
59
67
66
64
65
58
56
7
60
34
-8-

FUEL INJECTION SYSTEM

BACKGROUND OF THE INVENTION

The invention relates to a fuel injection system of the type described herein. A fuel injection system is already known in which a spring reservoir is provided in the fuel supply line for the purpose of preventing vapor bubbles after the internal combustion engine is turned off and to compensate for volumetric changes when the engine temperature is dropping after the engine is turned off or volumetric changes caused by leakage of fuel out of the system. However, in such a system there is the disadvantage that the reservoir volume cannot be made to be as large as desired, so that when the fuel injection system is not in operation the movable reservoir element contacts its end stop after a relatively short time, and further vapor bubble formation can no longer be prevented and a further compensation for a lessening in fuel volume is no longer possible. This often causes misfiring, in the event of restarting of the internal combustion engine, until such time as the system is again completely filled with fuel.

OBJECT AND SUMMARY OF THE INVENTION

The fuel injection system in accordance with the invention has the advantage over the prior art that the fuel injection system is filled with fuel before the starter motor of the internal combustion engine is actuated, so that a more secure start is assured for the internal combustion engine.

As a result of the features described in the dependent claims, further advantageous embodiments and improvements of the fuel injection system given in the main claim are possible.

The invention will be better understood as well as further objects and advantages thereof become more apparent from the ensuing detailed description of preferred embodiments taken in conjunction with the drawing.

BRIEF DESCRIPTION OF THE DRAWING

A preferred embodiment of the invention is presented in simplified form in the single FIGURE and described below in greater detail.

DESCRIPTION OF THE PREFERRED EMBODIMENT

Turning now to the drawing, there will be seen an embodiment of a fuel injection system including an intake manifold 1 having a conical section 2 which contains an air flow rate member 3 beyond which there is located an induction tube region 4 containing an arbitrarily actuatable throttle valve 5. Intake air flows through the induction tube in the direction of the arrow to a collection intake manifold 6 and from there through induction tube regions 7 to one or more cylinders 8 of the internal combustion engine.

In the present case, the air flow rate member 3 is a baffle plate disposed transversely with respect to the direction of air flow and capable of displacement within the conical region 2 of the induction tube in accordance with a certain function of the air flow rate through the tube. The air pressure between the air flow rate member 3 and the throttle valve 5 will be constant provided that the restoring force acting on the air flow rate member 3 is constant and that the air pressure ahead of the member 3 is also constant. The air flow rate member 3 controls the opening of a metering and distribution valve assembly 10. The air flow rate member 3 includes a main operating lever 11 and an auxiliary or correction lever 12. The motion of the air flow rate member 3 is transmitted by the operating lever 11 which is pivoted on the same shaft 13 as the correction lever 12 and which actuates the control slide 14 which is the movable member of the metering and distribution valve assembly 10. A mixture control screw 15 permits an adjustment of the desired fuel-air mixture.

Fuel is supplied by an electric fuel pump 19 which aspirates the fuel from a fuel tank 20 and delivers it through a filter 22 and a fuel supply line 23 to the fuel metering and distribution assembly 10. A fuel system pressure controller 24 maintains the system pressure in the fuel injection system constant.

The fuel supply line 23 splits into several branches which lead to first chambers 26 of the fuel valve assembly 10, whereby one side of a diaphragm 27 in each chamber is affected by fuel pressure. The first chambers 26 also communicate with an annular groove 28 of the control slide 14. Depending on the axial position of the control slide 14, the annular groove 28 overlaps control slits 29 to varying degrees permitting fuel to flow into second chambers 30 which are separated from the first chambers 26 by the diaphragm 27. From the second chambers 30, fuel flows through fuel injection lines 33 to the individual injection valves 34 which are located in the vicinity of the engine cylinders 8 in the induction tube region 7. The diaphragm 27 is the movable valve member of a plurality of control valves, each of which is held open by a spring 35 when the fuel injection system is not operating. The diaphragm boxes defined, in each case, by a chamber 26 and a chamber 30, insure that the pressure drop at the metering valve 28, 29 is constant independently of the relative overlap between the annular groove 28 and the control slits 29, i.e., independently of the fuel quantity flowing to the injection valves 34.

During a pivoting displacement of the operating lever 11, the air flow rate member 3 is moved into the conical region 2 so that the varying annular cross section between the flow rate member and the conical wall has a certain function with respect to the displacement of the air flow rate member 3.

The restoring force exerted on the control slide 14 and thus on the air flow rate member 3 may be generated by means of a compression spring 45, which is supported on the air flow rate member housing and urges the air flow rate member 3 in the closing direction. However, it is also sufficient to have an agreement between the lever weight and a compensation weight 44 on the other side of the pivot point 13. In any case, the restoring force on the control slide 14 can be generated by the fuel which serves as a pressure fluid. For this reason, a control pressure line 36 branches off from the fuel line 23 downstream of the first chambers 26 of the control valves 26, 30, 33, and is separated from the fuel supply line 23 by an uncoupling throttle 37. A pressure chamber 39 communicates via a damping throttle 38 with the control pressure line 36 and the control slide 14, which includes a front face 16, projects into this pressure chamber 39.

Downstream of the damping throttle 38 a pressure control valve 46 is provided in the control pressure line 36, through which the fuel can flow out of the control pressure line 36, without pressure, through a line 40 and from there back to the fuel tank 20. The pressure of the fuel in the pressure chamber 39, first, generates a restoring force on the air flow rate member 3 and, second, serves to damp the adjustment movement of the air flow rate member 3.

When the internal combustion engine is being turned off, the control slide 14 of the fuel metering and distribution valve 10 is displaced by the compression spring 45, by means, for example, of the compression spring 45 via the operating lever 11 of the air flow rate member 3, into a position in which the control slits 29 are closed by the control slide 14 but the front face 16 of the control slide 14 opens a flushing line 47, which branches off from the fuel supply line 23 and discharges into the pressure chamber 39. At the same time, the front face 16 of the control slide 14, in this position, opens flushing channels 48, which connect the pressure chamber 39 with each second chamber 30 of the control valves.

Outlet lines 60 are so positioned at the injection valves 34 that the fuel which is led through the injection lines 33 to each injection valve 34 flows through that valve and then into the appropriate outlet line 60. The outlet lines 60 lead from each injection valve 34 to a flushing valve 59, from which the fuel, when the flushing valve 59 is opened, can flow into the pressureless line 40 through a return flow line 43 and a pressure regulator 52. The flushing valve 59 has a yielding wall 51 which comprises a diaphragm and to which the movable valve parts of the flushing valve 59 are attached. The diaphragm 51 can move the movable valve parts 66 of the flushing valve 59 in a closing direction against the force of a flushing spring 67. This diaphragm 51, on its side remote from the valve parts 66, defines a pressure chamber 49 of the flushing valve 59 which is connected via a pressure line 50 with the fuel supply line 23. The several chambers in the flushing valve 59 which are separated by the diaphragm 51 are connected with one another by a restrictor element 53. An electromagnetic valve 54 is placed in pressure line 50 and is arranged to hold the pressure line 50 open in its non-energized state. The electromagnetic valve 54 lies within an electrical circuit 55, which in turn is connected to the vehicle battery 56 by a switching element 64, a time control element 65 and an ignition switch 58.

The mode of operation of the above-described fuel injection apparatus is as follows:

In a turned-off internal combustion engine, the control slide 14 of the metering and distribution valve assembly 10 are found in the illustrated position, in which it closes the control slits 29 and opens the flushing line 47 to the pressure chamber 39 and the flushing channel 48 between the pressure chamber 39 and the second chambers 30. In this operational state, through the force of the flushing valve the movable valve parts 66 of the flushing valve 59 open the outlet lines 60 from the injection valves 34 to the return line 43. During this time the electromagnetic valve 54 holds open the pressure line 50 between the fuel supply line 23 and the pressure chamber 49 of the flushing valve 59. An equalization of the fuel pressure on both sides of the diaphragm 51 in the flushing valve 59 can take place through the restrictor element 53.

If now the ignition circuit 58 is closed, then the electromagnetic valve 54 is energized and closes, and simultaneously the electric fuel pump 19 is energized and begins to pump fuel through the fuel supply line 23. Thus, fuel then flows through the flushing line 47 into the pressure chamber 39 and from there through the flushing channels 48 into the second chambers 30, from which the fuel flows through the injection lines 33 to the injection valves 34 and from there through the outlet lines 60, the opened flushing valve 59, the return line 43 and the pressure regulator 52 into the line 40 and back to the fuel tank 20.

The pressure regulator 52 maintains an opposing pressure which is higher than the vapor pressure of the fuel at its highest temperature so that it is assured that no further vapor bubbles arise from the fuel which may still be hot. Simultaneously with the fuel flushing through the injection valves 34 and the flushing valve 59, fuel is of course also flushed through the first chambers 26 of the metering and the distribution valve assembly 10 and through the control pressure line 36. With the closing of the ignition switch 58, a time control element 65, for example a multivibrator, is activated, which after a predeterminable period of time, which may be temperature-dependent (for example with a cold start ca. 3 seconds), causes the interruption, via the switching element 64, of the flow of current to the electromagnetic valve 54 and opens the pressure line 50 from the fuel line 23 to the pressure chamber 49. By this means, within a fraction of a second, for example 0.1 second, a pressure is built up in the pressure chamber 49 of the flushing valve 59, which causes the movable valve parts 66 to close the outlet lines 60 against the force of the flushing spring 67. Simultaneously with the interruption of the electrical circuit 55 of the electromagnetic valve 54, when a starter switch 63 is closed, an electrical circuit 61 of a starter motor 62 is closed. This motor 62 drives the internal combustion engine, so that the induced air flow moves the air flow rate member 3 in the air flow direction and the control slide 14 in the metering and distribution valve assembly 10 is so far displaced that with its front face 16 it closes the flushing line 47 to the pressure chamber 39 and the flushing channels 48 between the pressure chamber 39 and the second chambers 30; simultaneously, between the annular groove 28 and the control slits 29 fuel is metered in dependence on the induced air quantity and delivered to the injection valves 34.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection system for mixture-compressing, externally ignited internal combustion engines having an ignition switch, a fuel supply line and an intake manifold with fuel injection into said intake manifold, an electrical fuel pump for supplying fuel via said fuel supply line, a starter motor, an air flow rate member and an arbitrarily actuatable throttle valve arranged in tandem in said manifold, said air flow rate member being movable in proportion to the quantity of air flowing therethrough, a metering and distribution valve assembly having a control slide displaceable by said air flow rate member disposed in said fuel supply line for metering, at constant pressure, a quantity of fuel corresponding to the air quantity, a plurality of control valves inserted into the fuel flow downstream of each metering location, a diaphragm in the flow cross section defining first and second chambers for varying said plurality of control valves, the fuel pressure in said fuel supply line prevailing in said first chambers and, in the second chambers, the fuel pressure downstream of each metering location acts upon said diaphragm in the opening direction of said control valve, a control pressure line communicating with said fuel supply line downstream of said first chambers of said control valve via an uncoupling throttle, said control pressure line having a pressure chamber into which said control slide projects, a flushing line having flushing channels branching off from said fuel supply line which connect said pressure chamber with said second chambers, said control slide of said metering and distribution valve assembly having a front face and adapted to assume a position when the engine is being turned off in which said front face projects into said pressure chamber to open said flushing line and said flushing channels, a return flow line, an outlet line in which a flushing valve is disposed leading from each individual injection valve to said return flow line, said flushing valve having a diaphragm defining a pressure chamber on one side and having movable parts arbitrarily actuatable by said diaphragm, a pressure line for communicating said flushing valve pressure chamber with said fuel supply line, an electromagnetic valve disposed in said pressure line, a time control element, said electromagnetic valve being arranged to be actuated so that when said engine ignition switch is opened, it holds said pressure line open, and when said ignition switch is closed, the electrical circuit of said electrical fuel pump and of said electromagnetic valve is closed and said time control element is actuated, said time control element being arranged, after a predetermined period of time, to interrupt the electrical circuit of said electromagnetic valve and the electrical circuit of said starter motor to be closed, so that said electromagnetic valve opens said pressure line closes the previously opened flushing valve and therewith said outlet lines by means of the force of pressure then engaging the diaphragm of said flushing valve.

* * * * *